United States Patent [19]

Chun

[11] Patent Number: 4,498,669

[45] Date of Patent: Feb. 12, 1985

[54] HAND-HELD DEFENSE WEAPON

[76] Inventor: Dai S. Chun, 408 Urbantale St., Marrero, La. 70072

[21] Appl. No.: 513,364

[22] Filed: Jul. 13, 1983

[51] Int. Cl.[3] ..... F41B 15/00; B25B 15/00

[52] U.S. Cl. ..... 273/84 R; 7/165; 7/168; 81/440

[58] Field of Search ..... 273/84 R, 84 A, 84 ES; 7/165, 167, 168, 170; 81/439, 440; 30/226, 164.7, 286, 287; 70/456 R; 434/11

[56] References Cited

U.S. PATENT DOCUMENTS

| | | | |
|---|---|---|---|
| 36,081 | 8/1868 | Ernst | 434/11 X |
| 606,123 | 6/1898 | Coates | 30/226 X |
| 1,620,262 | 3/1927 | Klaboe | 7/167 |
| 2,609,019 | 9/1952 | Weber . | |
| 2,629,415 | 2/1953 | Baker | 7/165 X |
| 2,741,025 | 4/1956 | Stewart | 30/164.7 X |
| 2,821,724 | 2/1958 | Wurgaft . | |
| 3,364,508 | 1/1968 | Garrett . | |
| 3,742,533 | 7/1973 | Brunette . | |
| 4,052,063 | 10/1977 | Wong . | |
| 4,096,629 | 6/1978 | Levine . | |
| 4,100,637 | 7/1978 | Grieser et al. . | |
| 4,125,913 | 11/1978 | Lewis . | |
| 4,160,369 | 7/1979 | Pearson | 70/456 R |

*Primary Examiner*—William H. Grieb

*Attorney, Agent, or Firm*—Charles C. Garvey

[57] ABSTRACT

A hand-held defense weapon provides a first and second pair of shafts which are connected together at a common pivot located at the central portion of each shaft. A pair of handles are respectively on one end of each shaft and a pair of blunt elements are mounted on the other end of each shaft opposite the handle. A third shaft is connected to the common pivot at one end of that shaft with the shaft carrying a blunt element at the other end. The three shafts are thus independently movable with respect to the pivot and with respect to each other so that the apparatus can be positioned between any selected fingers of a user's hands, the shafts collapsing with respect to each other for storage to a position where the shafts are generally aligned side by side. The blunt elements can be removable to expose tips which are "tooled" such as Phillips, or flat-head screwdrivers or the like. Preferably the blunt elements would be spherical members threadably attached to the ends of the shafts.

10 Claims, 4 Drawing Figures

HAND-HELD DEFENSE WEAPON

BACKGROUND OF THE INVENTION

1. Technical Field

The present invention relates to hand-held defense weapons such as are commonly associated with the Martial Arts and more particularly relates to a combination hand-held defense weapon and hand-held tool wherein a plurality of shafts are pivotally connected so that they can be moved between any selected fingers of the user's hand and automatically compensate for differences in hand size, the individual shafts providing a plurality of selected tool tips such as screwdrivers which are manipulated by torque developed through one or more of the adjacent shafts.

2. General Background

Various types of defense have been developed over the years which are referred to generally as Martial Arts. These defense forms include, for example, Karate, Judo, Kung Fu, and the like. Some of these methods of defense include the use of a hand-held defense weapon which can be used to ward off an attacker who might be equipped with a knife, for example.

Hand-held tools have, in any given number of instances, been used as weapons. Many devices have been patented which have functioned as either a hand-held defense weapon or a tool and possibly a combination of the two.

U.S. Pat. No. 2,609,019 issued to C. S. Weber in 1952 is entitled "Multiple Bit Tool." This invention relates to a multiple bit tool, and more particularly to a tool in the nature of a screw driver which has three interchangeable tool elements having a bit at one end, any one of which tool elements can be brought into operative position while the remaining two are arranged in the handle or magazine portion.

U.S. Pat. No. 2,821,724 entitled "Slidably Housed Multi-Bladed Tool with Release Selection" issued in 1958 to R. L. Wurgaft. This invention relates to multiple-bladed hand tools in which any one of several blades may be selectively projected to an operating position, the others remaining so covered by the handle of the tool that they do not interfere with its operation.

A "Multipurpose Tool for Use with Golfers" is seen in U.S. Pat. No. 3,364,508 which issued to C. L. Garrett in 1968. This multipurpose pocket-size tool serves the needs of a golfer.

U.S. Pat. No. 3,742,533 issued to Samuel J. Brunette in 1973 discloses a multi-purpose tool which in a preferred embodiment is a flattened member having upper and lower flattened edges of predetermined width, with the lower edge having a groove extending along the edge receivable of a wing nut and of the shaft on which a wing nut would be mounted, and defining a through-space between opposite flattened faces of the tool with one face defining a circular shape around said through-space and having a diameter slightly less than that of a predetermined valve-face of a water-outlet valve of an aircraft gasoline tank such that upward pressure opens the valve whereby water in the bottom of the gas tank is drainable through the through-space of the tool.

U.S. Pat. No. 4,052,063 issued to Michael Wong discloses a "Multi-Purpose Protection Device" with a point on one end of a shaft and a butt on the other end, two opposite facing bent prongs connected to the middle of the shaft, and a deflector knob located near the bend of each prong on the outside surface of the prong.

The weapon is used in a close quarter situation. It may be held in a night stick position or in a pistol grip position. It can be readily changed from one position to the other—point to butt or pistol grip to night stick, or vice versa.

A "Multiple Bladed Retractable Claw Weapon" issued to Alfred B. Levine in 1978 is seen in U.S. Pat. No. 4,096,629. A pocket-sized claw-like multibladed weapon adapted to be held in the closed fist with the blades being spaced apart and projecting outwardly between adjoining fingers; likened to animal claws or talons of birds or prey.

U.S. Pat. No. 4,100,637 issued to Fred J. Grieser, Sr. in 1978 discloses a combination tool comprising a chuck key provided with at least one opening formed in the shaft thereof to receive therein a tool usually employed prior to the formation or following the formation of a hole in a structure. The chuck key is adapted to engage with the external teeth formed on one end of a chuck to either tighten or loosen the chuck on the tool such as a drill bit or the like.

U.S. Pat. No. 4,125,913 entitled "Multipurpose Tube Wrench" which issued to Lawrence J. Lewis in 1978 discloses an elongated cylindrical handle comprising an diametrical bore formed therethrough intermediate the ends thereof. A shower arm wrench body of hollow cylindrical configuration has an inner diameter equal to the diameter of the handle and an outer diameter greater than the diameter of the handle and is internally threaded and extends coaxially with a first end of the handle.

GENERAL DISCUSSION OF THE PRESENT INVENTION

The present invention provides a hand-held defense weapon which is readily adaptable to the hand of a large number of users because it automatically compensates for differences in configuration and size of the hand. Further, the present invention provides a hand-held defense weapon which can be held in a number of different positions. Further, the present invention provides a hand-held defense weapon which provides a number of tool tips such as a plurality of different size or configuration screwdrivers with the individual shaft portions of the apparatus being pivotally connected with respect to each other so that a given tool tip can be driven by twisting and hand applying the torque to one or more of the other shafts. Thus, the present invention provides a hand-held defense weapon having a first and second pair of shafts which are connected together at a common pivot located at the central portion of each of the first and second shafts. A pair of handles respectively are on each of the shafts at the end portion thereof. A pair of blunt elements are mounted on each shaft at the opposite end portion of the handles. These blunt elements can be removable to expose a tool tip such as a screwdriver, Phillips head or flat head.

A third shaft connected to the common pivot is connected at one end of the shaft and carries a blunt element which might be removable at the other end. The three shafts are independently movable with respect to each other so that the shafts can be positioned between the fingers of a user's hand, the shafts collapsing with respect to each for storage to a position where the shafts are generally aligned side by side.

The blunt elements can be spherical and are preferably freely removable such as by being threadably attached to the shaft tips. One of the handles preferably forms a clamp for removably securing that handle to a user's clothing such as a belt loop for easy storing when not in use. The handles can provide openings for the placement of one of the user's thumb or forefinger therethrough.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PRESENT INVENTION

Figure 1:
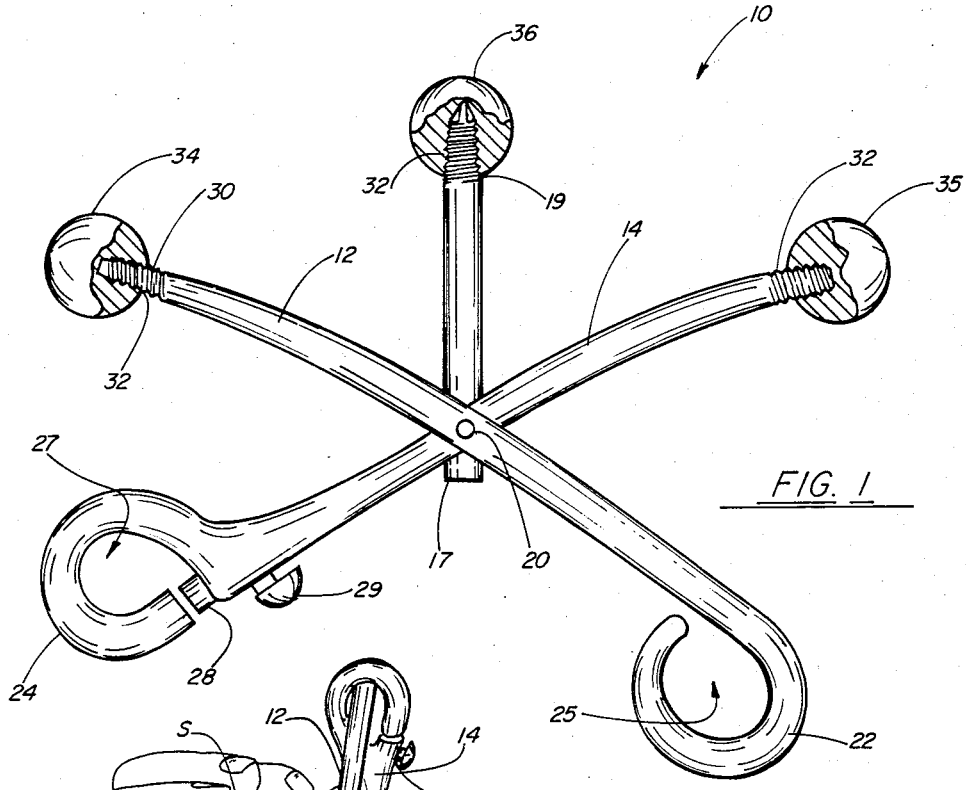
FIG. 1 is a frontal view of the preferred embodiment of the apparatus of the present invention.

FIG. 1 illustrates the preferred embodiment of the apparatus of the present invention designated generally by the numeral 10.

Hand-held defense weapon provides three shafts 12, 14, and 16 which are connected at common pivot 20. Pivot 20 would be simply a rivet, for example, which would pass through openings provided at the central portion of shafts 12, 14 and at the end portion of shaft 16. The three shafts 12, 14, 16 would be independently movable with respect to each other allowing collapsing of the shafts with respect to each other (see FIG. 4), or the collapsing of two shafts with respect to one remaining shaft (see FIG. 2) as, for example, when the apparatus 10 is used as a hand tool. In such an instance, for example, shaft 16 having a Phillips head tip might be used as a screwdriver with the remaining shafts 12, 14 collapsing upon each other in a generally aligned fashion with the shafts 12, 14 acting as a "tee bar" so that torque could be applied to shaft 16 by hand applied torque.

Each shaft 12, 14 provides handles 22, 24 at the end portion thereof. Opposite handle 22 is a tool tip 30 which would be externally threaded at 32 with male threads receptive of blunt tip 34 which would be preferably spherical.

Similarly, shaft 14 provides external threads 32 to which blunt element 35 would be threadably attached.

Central shaft 16 does not provide a handle 22, 24 but rather is affixed at its end portion 17 to pivot 20 with its opposite end portion 19 providing external threads 32 to which blunt spherical element 36 is attached.

The handles 22, 24 each provide openings 25, 27 through which a thumb or finger could be placed for gripping. The handle 24 could be, for example, a clamp having an opening shank 28 which is thumb actuated by means of button 29.

Figure 2:
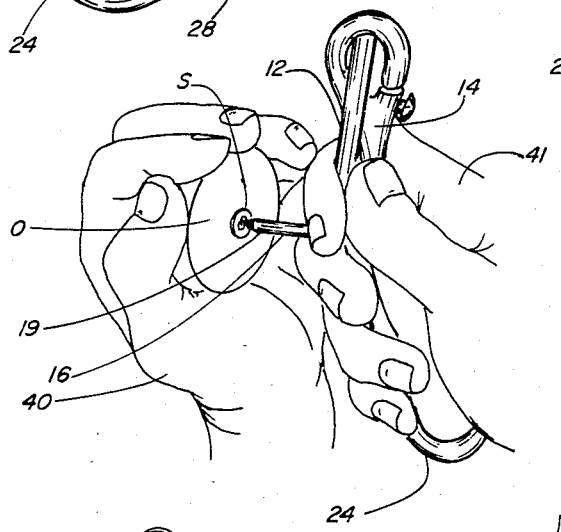
FIG. 2 is a perspective view of the preferred embodiment of the apparatus of the present invention showing its use as a screwdriver.

In FIG. 2, a pair of hands of a user 40, 41 are shown with the shafts 12, 14 being generally collapsed in an aligned fashion. The central shaft 16 has a tip 19 which might be, for example, equipped with a Phillips head which would be used to unthread or thread screw S mounted in object O.

Figure 3:
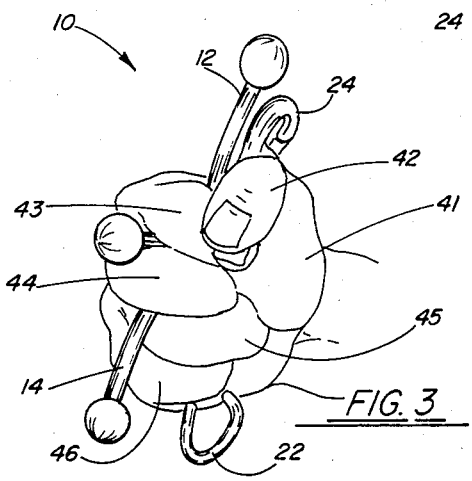
FIG. 3 is a perspective view of the preferred embodiment of the apparatus of the present invention as shown being gripped by a user's hand as a defense weapon.

In FIG. 3, apparatus 10 is shown being gripped by the hand 41 of a user. Note that the thumb of the user is designated by the numeral 42 while the fingers are designed by the numerals 43–46. Since shafts 12, 14, 16 are independently movable with respect to each other about pivot 20, any shaft could be placed between thumb 42 and desired fingers 43–46. Thus, for example, in FIG. 3 the shaft 12 is placed between thumb 42 and finger 43. The shaft 14 is placed between fingers 44 and 45 while the handle 24 is placed also in the space between thumb 42 and finger 43 while the handle 22 rests roughly in the palm of the hand 40. Because of the conforming nature of a human hand, any number of configurations could be used for gripping apparatus 10.

Figure 4:
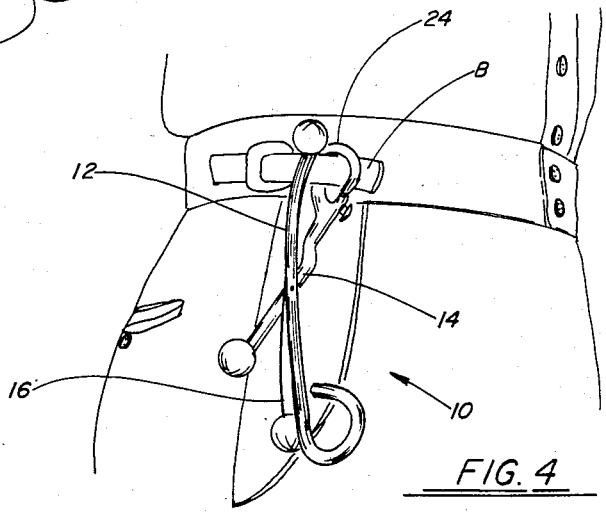
FIG. 4 is a schematic, perspective view of the preferred embodiment of the apparatus of the present invention showing it in a stored, non-use position on the belt loop of a user.

In FIG. 4, a user's belt loop "B" can be seen with the handle 24 in the form of a clamp attaching thereto. In this storage position, shafts 12, 14, 16 are generally collapsed so that all of the shafts are generally aligned.

Apparatus 10 could be manufactured of stainless steel or like metallic construction.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limited sense.

What is claimed as invention is:

1. A hand-held defense weapon comprising:

a. a pair of first and second shafts connected together at a common pivot located at the central portion of each shaft;

b. a pair of handles respectively on one end of each shaft;

c. a pair of blunt elements mounted on each shaft at the end opposite the handle; and d. a third shaft connected to the common pivot at one end, and carrying a blunt element at the other end, the three shafts being independently movable with respect to the other shafts and having a cross-section with a blunted outer surface so that the shafts can be positioned between the fingers of a user's hand and tightly gripped without injuring the user's hand, the shafts collapsing with respect to each other for storage to a position where the shafts are generally aligned side by side.

2. The apparatus of claim 1, wherein the blunt elements are freely movable.

3. The apparatus of claim 2, wherein at least one of the shafts has a tool point at the end covered by the blunt element.

4. The apparatus of claim 1, wherein the blunt elements are generally spherical.

5. The apparatus of claim 1, wherein at least one of the handles has an opening therethrough so that a user's thumb or finger can be placed through the opening.

6. The apparatus of claim 1, wherein the first and second shafts have a length of on the order of four inches.

7. The apparatus of claim 1 which further comprises a plurality of shafts with a cross-section means for allowing the shafts to be tightly gripped without injury to the hand.

8. The apparatus of claim 7 wherein the cross-section means includes an oval or rounded cross-sectional area of the shafts which communicate with the fingers of the user's hand.

9. A hand-held defense weapon comprising:

a. a pair of first and second shafts wherein each of the shafts has a tool point tip which is a conventional screwdriver connected together at a common pivot located at the central portion of each shaft;

b. a pair of handles respectively on one end of each shaft;

c. a pair of freely movable blunt elements mounted on each shaft at the end opposite the handle; and d. a third shaft connected to the common pivot at one end, and carrying a blunt element at the other end, the three shafts being independently movable with respect to the other shafts and having a cross-section with a blunted outer surface so that the shafts can be positioned between the fingers of a user's hands and tightly gripped without injury to the user's hand, the shafts collapsing with respect to each other for storage to a position where the shafts are generally aligned side by side.

10. The apparatus of claim 9, wherein the blunt elements are threadably affixable to the shaft.

* * * * *